US005960928A

United States Patent [19]

Bordignon et al.

[11] Patent Number: 5,960,928

[45] Date of Patent: Oct. 5, 1999

[54] METHOD TO MANAGE AN INSULATED COOLING BED AND RELATIVE INSULATED COOLING BED

[75] Inventors: Giuseppe Bordignon, Bicinicco; Gianni Gensini, Buia, both of Italy

[73] Assignee: Danieli & C. Officine Meccaniche SpA, Buttrio, Italy

[21] Appl. No.: 08/905,219

[22] Filed: Aug. 1, 1997

[30] Foreign Application Priority Data

Aug. 2, 1996 [IT] Italy ..... UD96A0148

[51] Int. Cl.[6] ..... B65G 47/10

[52] U.S. Cl. ..... 198/370.01; 198/347.3; 198/369.1

[58] Field of Search ..... 198/347.3, 369.1, 198/370.01

[56] References Cited

U.S. PATENT DOCUMENTS 1,729,696 10/1929 Akin .

FOREIGN PATENT DOCUMENTS

| | | |
|---|---|---|
| 1805239 | 5/1970 | Germany . |
| 8403359 | 11/1986 | Germany . |
| 3541654 | 5/1987 | Germany . |
| 3708050 | 9/1988 | Germany . |
| 29515422 U | 1/1997 | Germany . |

OTHER PUBLICATIONS

Patent Abstracts of Japan, vol. 008, No. 140 (M–305) Jun. 29, 1984 & JP 59 039414 A (Shin Nippon) Mar. 3, 1984—Abstract.

Patent Abstracts of Japan, vol. 012, No. 021 (M–661) Jan. 22, 1988 & JP 62 179801 A (Kobe Steel) Aug. 7, 1987—Abstract.

*Primary Examiner*—Jospeh E. Valenza

*Attorney, Agent, or Firm*—Antonelli, Terry, Stout & Kraus, LLP

[57] ABSTRACT

Method to manage an insulated cooling bed placed downstream of at least one continuous casting machine with one or more feeder ways (12*a*, 12*b*, 12*c*, 12*d*) and upstream of an outlet rollerway (20) associated with a reheating and temperature-equalisation furnace (15) serving a rolling mill (16), the cooling bed (11) comprising at the inlet a first bridge crane transfer (21*a*) to load the billets (13) from the feeder ways (12*a*, 12*b*, 12*c*, 12*d*) and cooperating at the outlet with a bench (14) to collect the billets (13), wherein the first bridge crane transfer (21*a*) removes the billets (13) from one rollerway (12) or the other and lays them gradually onto the cooling bed (11) insulated at least at the lower part, a second bridge crane transfer (21*b*) removes the billets (13) from one or another rollerway (12) or from the cooling bed (11) and lays the billets (13) on the outlet rollerway (20) or on the collection bench (14), the billets (13) being made to advance on the cooling bed (11) rotating on their axis. Cooling bed placed between at least a continuous casting machine and a rolling mill (16), including upstream one or more feeder rollerways (12) and downstream an outlet rollerway (20) associated with a bench (14) to collect cold billets and with a reheating and temperature-equalisation furnace (15), the bed comprising positioning seatings (19) for the billets (13) and a first bridge crane transfer (21*a*), the cooling bed (11) including at least at the lower part an insulated containing structure (18) and comprising a second bridge crane transfer (21*b*) which is driven autonomously and independently in relation to the first bridge crane transfer (21*a*), the second bridge crane transfer (21*b*) being functionally associated at least with the feeder rollerways (12), the positioning seatings (19) for the billets (13) and the outlet rollerway (20).

8 Claims, 3 Drawing Sheets

METHOD TO MANAGE AN INSULATED COOLING BED AND RELATIVE INSULATED COOLING BED

BACKGROUND OF THE INVENTION

This invention concerns a method to manage an insulated cooling bed, and also the relative insulated cooling bed used in the method.

The invention is applied in production plants for in-line rolling starting from continuous casting, whether the plants are completely hot-loaded, when the production of the casting plant is higher than or equal to the production of the rolling mill, or the plants are mixed-loaded, when the production of the rolling mill is higher than that of the casting plant and therefore there is a mixed feeding system of hot/cold-load.

The state of the art includes in-line rolling plants where the slab leaving the continuous casting machine is sheared to size in sections of the desired length, which are loaded in a cooling bed by means of the appropriate transfer and subsequently sent to the rolling train through a reheating furnace in order to restore and equalise the temperature of the slab.

In such rolling lines, the cooling bed placed downstream of the continuous casting machine and the shearing unit is basically used as a functional connection between the functioning sequences of the casting plant and those of the rolling mill. In other words, the cooling bed functions as a variable accumulator for the billets as they are produced by the continuous casting, and also as a positioning seating for the cold billets in the case of mixed loading, the billets then being fed to the reheating furnace and then to the rolling mill.

The cooling bed also functions as an emergency store in the event that any accidents, blockages, maintenance operations on or substitution of the rollers, changes of channel or other, should block or slow down the rolling train while the casting machine continues to function.

Cooling beds known to the state of the art, since they work at ambient temperature, have the problem that they cause a considerable fall in temperature in the billets which have gradually accumulated.

This is also due to the fact that these billets remain in the cooling bed for quite a long time because of the sizes, often considerable, of the beds themselves; however these sizes are necessary if the beds are to function as variable accumulators, as the rolling plant requires.

Therefore, the reheating furnace situated downstream of the cooling bed has to perform a burdensome task of restoring the temperature of the slab, which involves a considerable consumption of energy.

Moreover, this makes it necessary to reduce the feeding speed of the slabs to the rolling train, in order to restore the slabs to an optimum temperature or, alternatively, makes it difficult to obtain the most suitable temperatures to achieve an efficient rolling.

Furthermore, with cooling beds known to the state of the art it is not possible to achieve efficient feeding systems of the slabs to the furnace either with a completely hot load or with a mixed load, given the structural and functional problems caused by loading the billets from the casting plant to the bed, and unloading the billets from the bed to the rollerway to feed the billets to the furnace.

JP-A-59-039414 includes a cooling bed with an upper movable cover.

The upper movable cover serves to cooperate with one lengthwise part of the cooling bed or the other.

The upper movable cover is equipped with autonomous ventilators which feed specific ventilation mouths which cooperate with temperature monitors to control the cooling gradient.

In this way it is possible to control the cooling of the billets placed under the movable cover and to obtain the desired heat treatment.

DE-A-3541654 includes normal reheating furnaces with thrust operated lateral translation, associated with manipulator devices for the slabs when a complete and precise uniformity of temperature is required throughout the slab.

Neither of these two prior art documents deals with the problem posed by this invention, nor do they provide any valid indication which might lead to the problem posed by this invention, or to the solution thereof.

It should be remembered that modern technology requires that the billet produced by continuous casting must go directly, and in the hottest conditions possible, to the rolling mill, in order to save on time and energy, the billet transiting directly through the reheating and temperature-equalisation furnace.

Unfortunately, the perfect synchrony between casting and rolling mill does not exist, both because of repetitive factors (change of casting, change of crystalliser, routine maintenance, etc.) and also because of jamming or incidents (slowdowns, breakages, non-routine maintenance, etc.).

SUMMARY OF THE INVENTION

The present applicants have designed, tested and embodied this invention so as to overcome the shortcomings of the state of the art and to achieve further advantages.

The purpose of the invention is to provide a cooling bed suitable to reduce the operating and management costs of the downstream reheating and temperature-equalisation furnace, and also to reduce the time needed by the furnace to restore the slabs to a suitable temperature for rolling.

The invention also has the purpose of eliminating furnaces or chambers needed to maintain the heat of the slabs; this is to save on space, capital investment, maintenance, staff, etc., and thus to obtain a reduction in length of the plant.

Additionally, the invention intends to cool the slabs in a homogeneous manner, so that the slabs do not have areas with different temperatures.

A further purpose is to obtain a cooling bed suitable to optimise the feeding sequences to the furnace, both in the case of hot-loading and in the case of mixed hot/cold loading.

The cooling bed according to the invention makes it possible to manage in an optimum manner both sequences where the production of the casting plant is greater than that of the rolling mill, and also the opposite, that is to say, where the production of the rolling mill is equal to or greater than that of the casting plant.

Furthermore, the cooling bed according to the invention makes it possible to manage easily and efficiently both situations where the casting is changed, and also emergency situations, for example when there is a blockage in the rolling line.

Further advantages of the cooling bed according to the invention are that investment costs are extremely reduced because mainly existing structures are used, that there is a reduction in the spaces and the bays of the plants used for rolling mills, and also that there is a reduced need for routine and non-routine maintenance.

The cooling bed according to the invention is suitable to cooperate with a casting machine having several casting lines, or with several casting machines associated with a single rolling train.

The cooling bed is associated at the inlet with feeder rollerways connected with the relative casting lines which progressively feed the billets. The cooling bed is also associated with at least a collection bench for the load, where the billets cool and onto which they are unloaded when the bed has been completely filled, for example when there is a prolonged interruption in the rolling line.

According to the invention, the cooling bed is associated at the lower part and at the sides with a containing and insulation structure made of, or lined by, heat insulating materials. The function of this insulated structure is to greatly reduce the speed of cooling of the billets in the bed, and therefore to feed hotter billets to the reheating furnace.

According to a variant, the cooling bed cooperates also at the upper part with an insulated structure to maintain the temperature.

In this condition, the hot billet laid on the bed not only does not lose much heat and retains its temperature for a long time, but also it maintains a correct uniformity of temperature over its whole surface, since it is made to rotate continuously as it advances by the appropriate means associated with the relative positioning seatings.

According to the invention, the cooling bed has, on the opposite side to the rollerways connected to the casting lines, a rollerway arranged to feed the billets to the reheating and temperature-equalization furnace and therefore to feed the rolling line with a hot load.

This rollerway also cooperates with the collection bench of the cold load and can therefore be used to achieve feeding configurations with a mixed hot/cold load.

According to the invention, the cooling bed is associated with at least two independent transfer systems for the billets, of which one is substantially used to transfer the billets from the inlet rollerways into the bed, and the other is substantially used to transfer the billets from the bed to the rollerway to feed the reheating and temperature-equalisation furnace.

However, the second transfer system is also able to cooperate with the inlet rollerways so as to transfer the billets directly into the cooling bed or onto the rollerways to feed the furnace or also to the collection bench.

Therefore, with this invention, it is possible to take a billet arriving from the rollerway associated with the continuous casting machine and take it directly to the rollerway associated with the reheating and temperature-equalisation furnace.

This system of two independent transfers makes it possible to optimise the working sequences both with a hot-load feed and with a mixed-load feed, and also to manage efficiently any situations of changing the casting machine and emergency situations.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
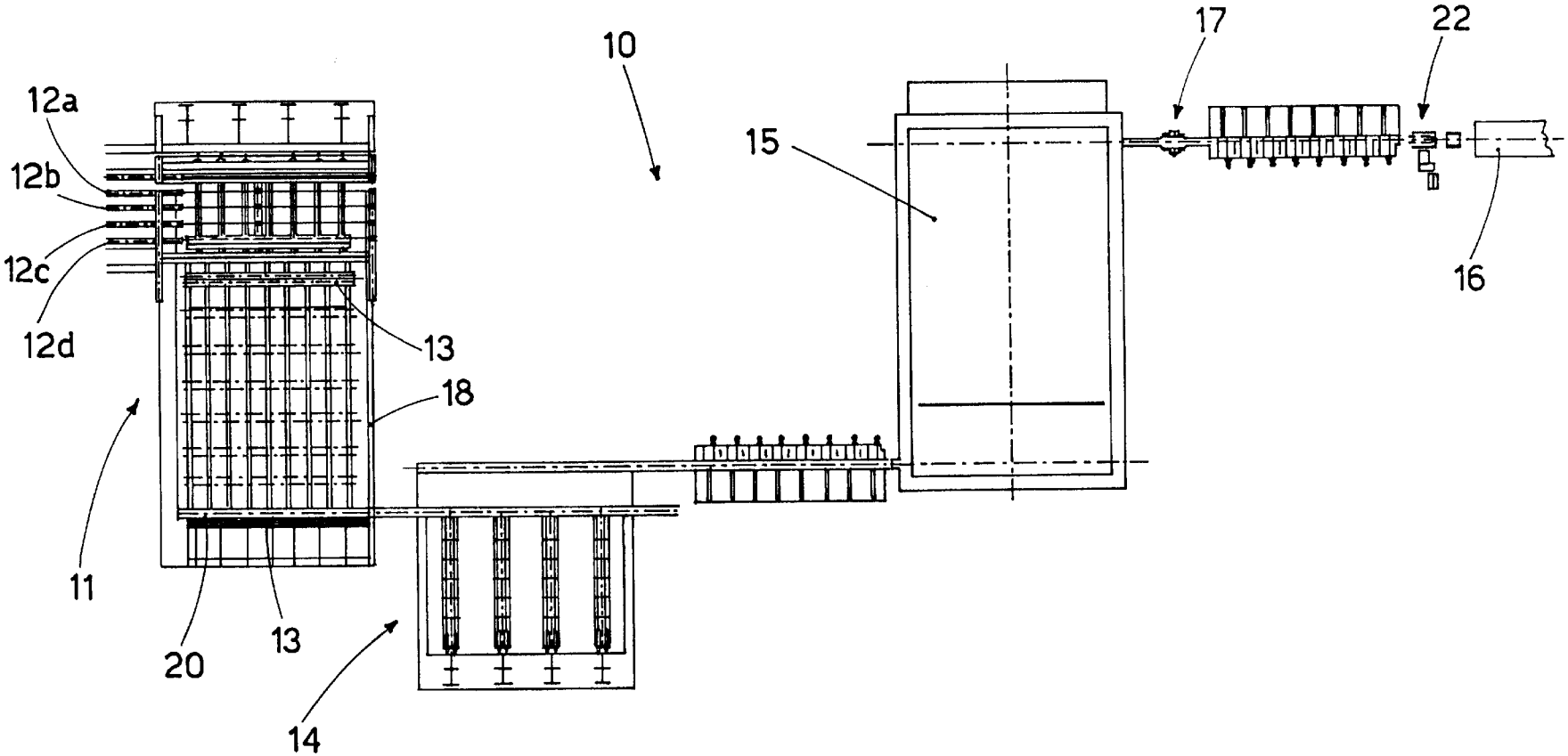
FIG. 1 shows a possible lay-out of the rolling plant using the insulated cooling bed according to the invention.

The rolling plant 10 shown diagrammatically in FIG. 1 comprises a cooling bed 11 associated, in this case, with four rollerways, respectively 12*a*, 12*b*, 12*c* and 12*d*, which feed billets 13 sheared to size coming from the relative casting machines.

The plant 10 also comprises a collection bench 14 for cold loading which, together with the cooling bed 11, feeds the reheating and temperature-equalization furnace 15 placed in line with the rolling mill 16 in the case of mixed hot/cold loading which substantially occurs when the production of the rolling mill 16 is higher than that of the casting plant.

At the outlet of the reheating and temperature-equalization furnace 15, in this case, there is a descaling unit 17 whereas at the inlet to the rolling mill 16 there is a pinch roll drawing unit 22.

The cooling bed 11 comprises an insulating structure 18 arranged to cooperate at least at the lower part and at the sides with the toothed positioning seatings 19 for the billets 13.

The positioning seatings 19 cooperate with means which are not shown here to make the billets 13 rotate on their axis as they gradually advance on the bed 11.

Figure 5:
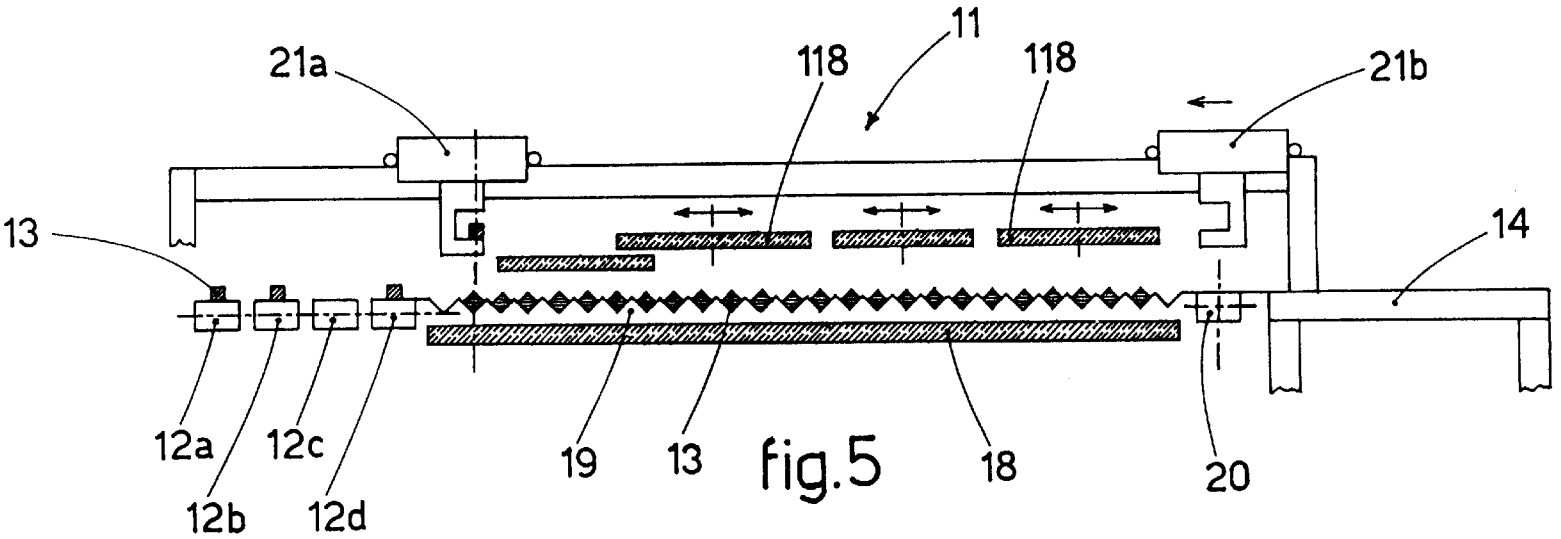
FIG. 5 shows a variant of the cooling bed according to the invention shown in FIGS. 2–4.

According to the variant shown in FIG. 5, there is an insulating structure 118 also at the upper part of the toothed positioning seatings 19.

These insulating structures 18, 118, made of or lined by insulating materials, have the function of defining a structure which is partly closed and at least partly insulated thermically in order to delay the cooling of the billets 13 in the cooling bed; in this way it is possible to supply, at the outlet of the bed 11, billets 13 which still have quite a high temperature and therefore do not require a great deal of reheating inside the reheating and temperature-equalisation furnace 15.

The cooling bed 11 has, on the side opposite the inlet rollerways 12*a*, 12*b*, 12*c* and 12*d*, an outlet rollerway 20 which feeds the billets 13 to the reheating and temperature-equalization furnace 15.

The outlet rollerway 20 is pre-arranged to receive both the billets 13 fed by the cooling bed 11, when the rolling mill 16 is fed with a hot load, and also the billets 13 supplied from the collection bench 14, when the rolling mill 16 is fed with a mixed hot/cold load.

The transfer of the billets 13 is achieved by two movement systems of the bridge crane transfer type, respectively 21*a* and 21*b*, which work independently of each other and in a coordinated manner in relation to the production times of the casting plant and the rolling mill 16, and according to whether the feed is hot load or mixed load.

In the event that there is the upper insulating structure 118, this structure is movable, as shown by the arrows in FIG. 5, to allow the bridge crane transfers 21*a* and 21*b* to be activated and to work, or at least the first bridge crane transfer 21*a*, which can thus lay down or pick up the billets 13 into or from any desired lengthwise position of the bed.

Figure 2:
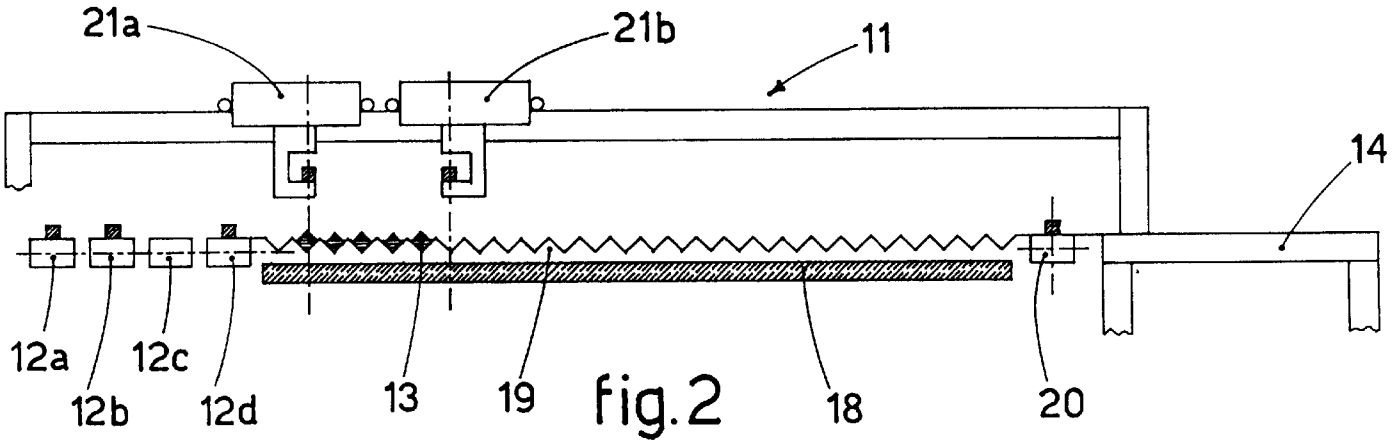
FIG. 2 shows a first example of the working of the bed according to the invention.
Figure 3:
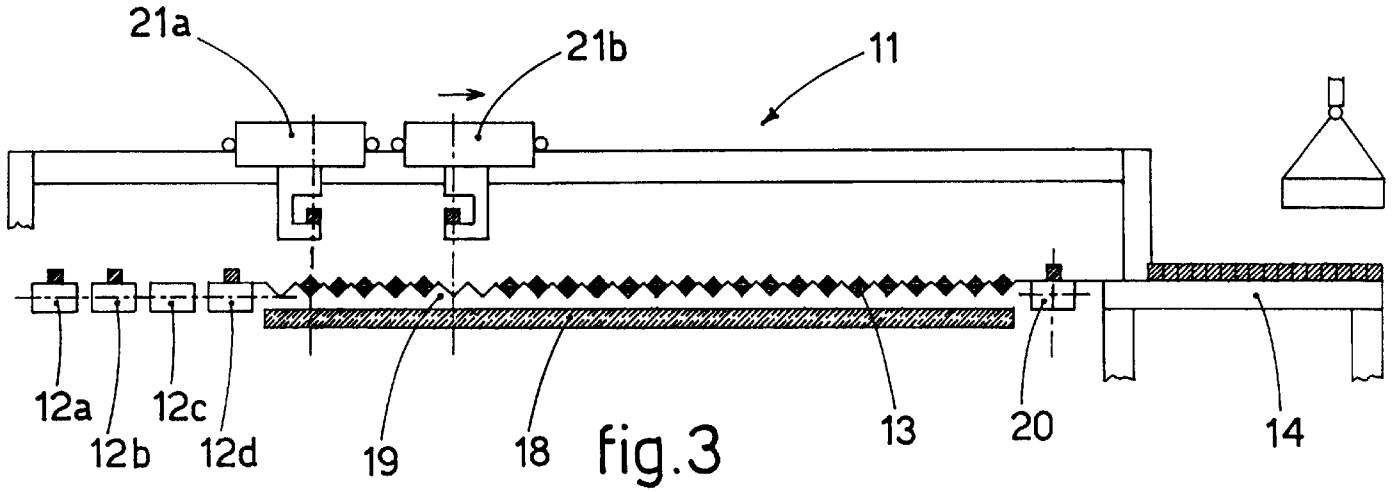
FIG. 3 shows a second step in the working cycle of the cooling bed according to the invention in FIG. 2.

FIGS. 2 and 3 show the situation when the production of the rolling mill 16 is lower than that of the casting plant.

According to the working sequence, a number of billets 13 are loaded into the positioning seatings 19 by means of the first transfer 21*a*, until there is space on the cooling bed 11 to allow the second transfer 21*b* to be moved also. At this point, the transfer 21*b* begins to load the rollerway 20 with the billets 13 removed from the seatings 19, the rollerway 20 feeding the hot billets 13 to the reheating furnace 15 at optimum temperature conditions, given that the billets 13 have suffered a limited temperature loss in the cooling bed 11.

Since the production of the casting plant is greater than that of the rolling mill 16, after a certain number of castings the cooling bed 11 is completely full (FIG. 3), and so it is necessary to unload the billets 13 of at least one casting onto the collection bench 14, while the following casting restarts its normal cycle, loading the hot billets 13 directly into the furnace. With this system of the double transfer 21*a*, 21*b*, it is therefore possible to manage emergency situations such as for example a blockage of the rolling mill 16, with the billets 13 being unloaded into the bed 11 or onto the collection bench 14; it is also possible to restart rolling without mixing the castings one with the other, as the second transfer 21*b* can remove the billets 13 at any point of the bed 11.

Figure 4:
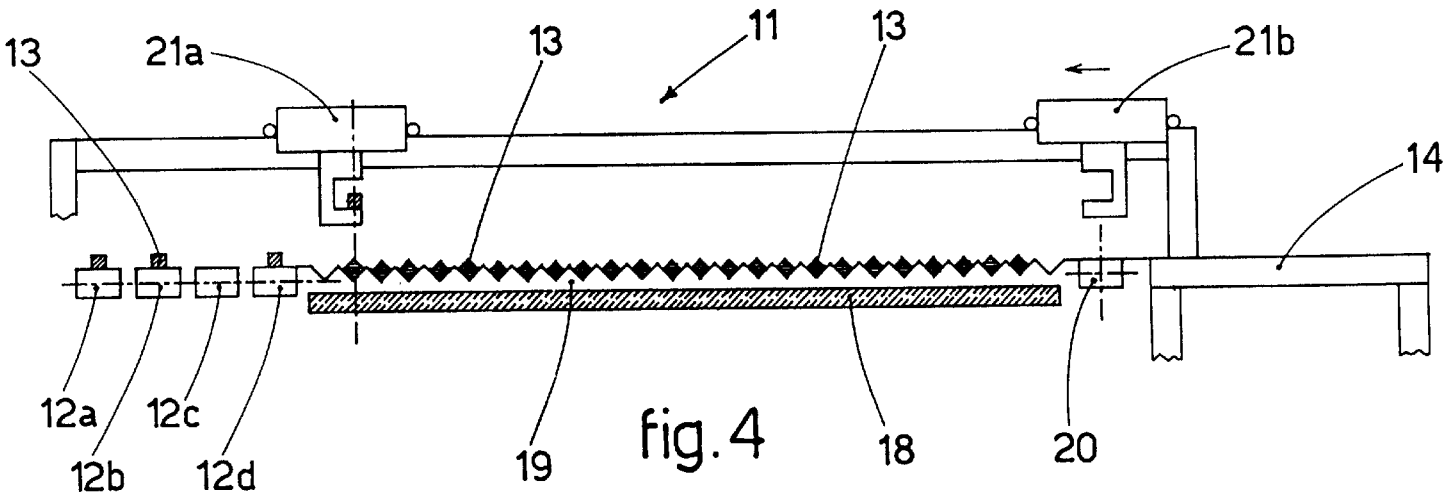
FIG. 4 shows a second example of the working of the bed according to the invention.

FIG. 4 shows the situation when the production of the rolling mill 16 is greater than that of the casting plant.

In this case, according to the working sequence, there is an initial feed to the reheating furnace 15 with billets 13 all cold, while the hot billets 13 coming from the casting plant are accumulated in the insulated bed 11.

When the accumulation, calculated according to the working parameters and particularly according to the correlation between the production of the rolling mill 16 and the production of the casting plant, has been completed, the next step—direct feed with a completely hot load—is begun.

All the time the accumulated billets 13 are being discharged from the bed 11, the production of the rolling mill 16 is equal to the production of the casting plant, until the bed 11 is emptied of billets 13, and then cold loading is begun again.

Finally, in the situation where the production of the rolling mill 16 is equal to that of the casting plant, then the billets 13 as they are produced by the casting plant are removed directly from the rollerways 12 by the second transfer 21*b* and unloaded onto the rollerway 20 and thus fed to the reheating and temperature-equalization furnace 15.

The emergency situations are managed by accumulating the billets 13 in the bed 11 until it is full, and if necessary using the collection bench 14 also; then, the accumulation thus produced is discharged by an overproduction in the rolling mill 16.

According to a variant which is not shown here, the second transfer 21*b* is able to remove the billets 13 directly from the inlet rollerways 12 and lay them either in the bed 11 or on the outlet rollerway 20 or also on the collection bench 14.

We claim:

1. Method to manage an insulated cooling bed placed downstream of at least one continuous casting machine with one or more feeder ways and upstream of an outlet rollerway associated with a reheating and temperature-equalisation furnace serving a rolling mill, the cooled bed comprising at the inlet a first bridge crane transfer to load the billets from the one or more feeder ways and cooperating at the outlet with a bench to collect the billets, the method comprising removing the billets from the one or more feeder ways with the first bridge crane transfer and laying them gradually onto the cooling bed insulated at least at the lower part, removing the billets from the one or more feeder ways or from the cooling bed with a second bridge crane transfer and laying the billets on the outlet rollerway or on the collection bench, the billets being made to advance on the cooling bed rotating on their axis.

2. Method as in claim 1, in which, when the nominal production of the casting plant is greater than the nominal production of the rolling mill, the billets are progressively loaded from the feeder ways into the bed by the first bridge crane transfer and at the same time loaded from the bed to the rollerway to feed the reheating and temperature-equalization furnace by the second bridge crane transfer, there being included a step where the billets are removed onto the collection bench carried out by the second bridge crane transfer to remove the excess production of the casting plant with respect to the rolling mill.

3. Method as in claim 1, in which, when the nominal production of the rolling mill is greater than that of the casting plant, the reheating and temperature-equalization furnace is first fed with billets from the collection bench until the desired accumulation of billets produced by the casting plant is obtained in the cooling bed, the billets in the bed then being fed to the reheating and temperature-equalization furnace, thus obtaining, until the bed is completely emptied, a coincidence between the nominal production of the casting plant and the nominal production of the rolling mill (16).

4. Method as in claim 1, in which, when the nominal production of the rolling mill is equal to that of the casting plant, the billets loaded into the bed by the first bridge crane transfer are removed by the second bridge crane transfer and loaded directly onto the rollerway to feed the reheating and temperature-equalization furnace.

5. Cooling bed placed between at least a continuous casting machine and a rolling mill, including upstream one or more feeder rollerways and downstream an outlet rollerway associated with a bench to collect cold billets and with a reheating and temperature-equalisation furnace, the bed comprising positioning seatings (19) for the billets and a first bridge crane transfer, the cooling bed being characterised in that it includes at least at the lower part an insulated containing structure and comprises a second bridge crane transfer which is driven autonomously and independently in relation to the first bridge crane transfer (21*a*), the second bridge crane transfer being functionally associated at least with the feeder rollerways, the positioning seatings for the billets and the outlet rollerway.

6. Cooling bed as in claim 5, which has an insulated containing structure at its upper part of a movable type according to the activation at least of the first bridge crane transfer.

7. Cooling bed as in claims 5 or 6, in which the second bridge crane transfer is functionally associated with the collection bench.

8. A rolling plant comprising:

at least one inlet feeder rollerway for feeding billets sheared to size from a continuous casting machine;

a cooling bed provided downstream of the at least one inlet feeder rollerway, the cooling bed including a plurality of positioning seatings for the billets and an insulating containing structure provided at least at a lower portion of the cooling bed;

a bench provided downstream of the cooling bed to collect billets;

an outlet rollerway provided between an outlet of the cooling bed and the bench;

a temperature equalization furnace provided downstream of the bench;

a first bridge crane transfer for transferring billets from the at least the inlet feeder rollerway to the cooling bed; and a second bridge crane transfer, driven autonomously and independently from the first bridge crane transfer, for transferring billets from the at least one inlet feeder rollerway or from the cooling bed to the outlet feeder rollerway.

* * * * *